US008727796B2

(12) United States Patent
Ngo

(10) Patent No.: US 8,727,796 B2
(45) Date of Patent: May 20, 2014

(54) POWER CONNECTOR

(75) Inventor: Hung Viet Ngo, Austin, TX (US)

(73) Assignee: FCI Americas Technology LLC, Carson City, NV (US)

( * ) Notice: Subject to any disclaimer, the term of this patent is extended or adjusted under 35 U.S.C. 154(b) by 63 days.

(21) Appl. No.: 13/571,884

(22) Filed: Aug. 10, 2012

(65) Prior Publication Data

US 2013/0040500 A1 Feb. 14, 2013

Related U.S. Application Data

(60) Provisional application No. 61/522,994, filed on Aug. 12, 2011.

(51) Int. Cl.
*H01R 12/00* (2006.01)

(52) U.S. Cl.
USPC ..... 439/79; 439/660

(58) Field of Classification Search
USPC ..... 439/79, 660, 65, 84, 259, 825
See application file for complete search history.

(56) References Cited

U.S. PATENT DOCUMENTS

| | | | | |
|---|---|---|---|---|
| 4,464,832 | A * | 8/1984 | Asick et al. | 29/839 |
| 5,664,968 | A * | 9/1997 | Mickievicz | 439/607.1 |
| 6,171,140 | B1 * | 1/2001 | Anbo et al. | 439/516 |
| 6,183,287 | B1 * | 2/2001 | Po | 439/358 |
| 6,203,328 | B1 * | 3/2001 | Ortega et al. | 439/60 |
| 6,290,514 | B1 * | 9/2001 | McHugh et al. | 439/108 |
| 6,319,075 | B1 * | 11/2001 | Clark et al. | 439/825 |
| 6,394,818 | B1 * | 5/2002 | Smalley, Jr. | 439/79 |
| 6,652,322 | B2 * | 11/2003 | Ito et al. | 439/637 |
| 6,716,045 | B2 | 4/2004 | Meredith | |
| 7,059,892 | B1 * | 6/2006 | Trout | 439/465 |
| RE39,380 | E * | 11/2006 | Davis | 439/660 |
| 7,137,848 | B1 * | 11/2006 | Trout et al. | 439/465 |
| 7,374,436 | B2 * | 5/2008 | Schell et al. | 439/79 |
| 7,862,359 | B2 * | 1/2011 | Daily et al. | 439/290 |
| 8,043,097 | B2 * | 10/2011 | Ngo et al. | 439/79 |
| 8,096,814 | B2 * | 1/2012 | Schell et al. | 439/79 |
| 8,096,832 | B2 * | 1/2012 | Minich et al. | 439/607.05 |
| 8,187,017 | B2 * | 5/2012 | Daily et al. | 439/290 |
| 8,323,049 | B2 * | 12/2012 | Ngo | 439/552 |
| 8,328,583 | B2 * | 12/2012 | Yu | 439/651 |
| 8,403,707 | B2 * | 3/2013 | Tai | 439/619 |
| 2002/0106930 | A1 * | 8/2002 | Pape et al. | 439/485 |
| 2009/0042417 | A1 * | 2/2009 | Ngo et al. | 439/79 |
| 2011/0159727 | A1 * | 6/2011 | Howard et al. | 439/540.1 |
| 2012/0156909 | A1 * | 6/2012 | Tyler | 439/259 |

* cited by examiner

*Primary Examiner* — Alexander Gilman
(74) *Attorney, Agent, or Firm* — Baker & Hostetler LLP

(57) ABSTRACT

An electrical power connector can include a connector housing having a front end defining a mating interface that includes a receptacle defined by opposing first and second surfaces. The interface can further include a plurality of first dividers that extend from the first surface and into the receptacle, and a plurality of second dividers that extend from the second surface and into the receptacle. The connector can further include a first row of contact beams and a second row of contact beams supported by the housing. Each contact beam of the first and second rows extends at least partially into the receptacle. The contact beams of the first row are separated from each other by the first dividers, and the contact beams of the second row are separated from each other by the second dividers such that a minimum creep distance between adjacent contact beams is greater than 1.0 mm.

20 Claims, 15 Drawing Sheets

POWER CONNECTOR

CROSS REFERENCE TO RELATED APPLICATIONS

This application claims priority to U.S. Provisional Application No. 61/522,994, filed Aug. 12, 2011, the contents of which are hereby incorporated by reference herein.

BACKGROUND

Connectors used to transmit electrical power, such as alternating current (AC) power and/or direct current (DC) power include power contacts mounted within an electrically-insulated housing. In a typical application, a receptacle connector includes two rows of power contacts (or a single row of power cable assemblies) that are configured to mate with a single row of power contacts of a corresponding header connector. The power contacts of the receptacle connector may each define single beam, two beam, or even four beam mating ends. In high powered applications, the beams or mating ends of adjacent contacts are separated by a divider that is defined by the housing. The divider may increase a minimum creep distance between the adjacent contacts so as to increase the maximum working voltage of the connector. That is, the minimum distance between adjacent power contacts taken along the surface of an insulating material between the two power contacts is increased.

Power connectors are designed to have a low profile and a high working voltage. For example, a standard high powered receptacle connector has two rows of power contacts with a pitch of about 10.16 mm, and a minimum creep distance of about 0.7 mm. These standard connectors can achieve a current density of about 150 A/inch, and a maximum working voltage of 100V AC (140V DC). While such connectors are an improvement over earlier connectors, there remains a need to achieve higher working voltages while at the same time minimizing the overall profile of the connector.

SUMMARY

An electrical power connector with improved operating characteristics is provided. The connector include a connector housing having a front end defining a first mating interface that includes a first opening defined by opposing first and second surfaces. The mating interface further includes a plurality of first dividers that extend from the first surface and into the first receptacle, and a plurality of second dividers that extend from the second surface and into the first receptacle. The connector further includes a first row of first power contacts and a second row of second power contacts supported by the housing. Each first power contact defines a first mating end that extends at least partially into the first receptacle. The second row of second power contacts are supported by the housing at a location spaced from the first row of first power contacts. Each second power contact defines a second mating end that extends at least partially into the first receptacle. The first mating ends are separated from each other by the first dividers, and the second mating ends are separated from each other by the second dividers such that a minimum creep distance between adjacent first mating ends and between adjacent second mating ends is between about 2.0 mm and about 4.0 mm. The electrical power connector has a maximum working voltage that is greater than 100 V.

In another embodiment the electrical power connector includes a connector housing that can include first and second walls that are spaced from each other so as to define a receptacle. The first wall can include a plurality of dividers that extend toward the second wall, each of the dividers can comprise a material that has a first dielectric constant and can each define an outer surface. The connector can further include a row of electrical power contacts supported by the housing. Each power contact can define a mating end that is at least partially disposed in the receptacle such that a contact pitch measured between respective centers of adjacent mating ends is between about 7 mm and about 12 mm. A select one of the dividers is disposed between first and second successive ones of the power contacts of the row, and the connector housing can define a region having a second dielectric constant less than the first dielectric constant and is disposed between the first and second successive ones of the power contacts. The connector defines a shortest distance between the first and second successive ones of the power contacts. The shortest distance can be measured 1) at least partially along the outer surface of the select one of the dividers and 2) only in the region, such that no other distance measured between the first and second successive ones of the power contacts at least partially along the outer surface of the select one of the dividers and only in the region is shorter than the shortest distance. The shortest distance can be between about 2 mm and about 4 mm and the electrical power connector can have a maximum working voltage that is greater than 400 V.

In another embodiment, the electrical power connector comprises a connector housing having a front end that defines a first mating interface that includes first and second walls spaced from each other so as to define a first receptacle and a second mating interface spaced from the first mating interface along a first direction, the second mating interface includes third and fourth walls spaced from each other so as to define a second receptacle. The first wall can have a plurality of first dividers that extend toward the second wall, the second wall can have a plurality of second dividers that extend toward the first wall, the third wall can have a plurality of third dividers that extend toward the fourth wall, and the fourth wall can have a plurality of fourth dividers that extend toward the third wall. The connector further includes a first row of contact beams supported by the housing, each contact beam extending at least partially into the first receptacle, a second row of contact beams supported by the housing, each contact beam of the second row extending at least partially into the first receptacle, a third row of contact beams supported by the housing, each contact beam of the third row extending at least partially into the second receptacle, and a fourth row of contact beams supported by the housing, each contact beam of the fourth row extending at least partially into the second receptacle.

Groups of at least two contact beams of the first row of contact beams are separated from each other by the first dividers, groups of at least two contact beams of the second row of contact beams are separated from each other by the second dividers, groups of at least two contact beams of the third row of contact beams are separated from each other by the third dividers, and groups of at least two contact beams of the fourth row of contact beams are separated from each other by the fourth dividers such that a minimum creep distance between adjacent groups of contact beams of the first row, between adjacent groups of contact beams of the second row, between adjacent groups of contact beams of the third row, and between adjacent groups of contact beams of the fourth row is between about 1.0 mm and about 5.0 mm. The electrical power connector can have a maximum working voltage that is greater than 300 V.

BRIEF DESCRIPTION OF THE DRAWINGS

The foregoing summary, as well as the following detailed description of example embodiments, are better understood when read in conjunction with the appended diagrammatic drawings. For the purpose of illustrating the invention, the drawings show illustrative embodiments. The invention is not limited, however, to the specific embodiments disclosed in the drawings.

DETAILED DESCRIPTION OF ILLUSTRATIVE EMBODIMENTS

Figure 1:
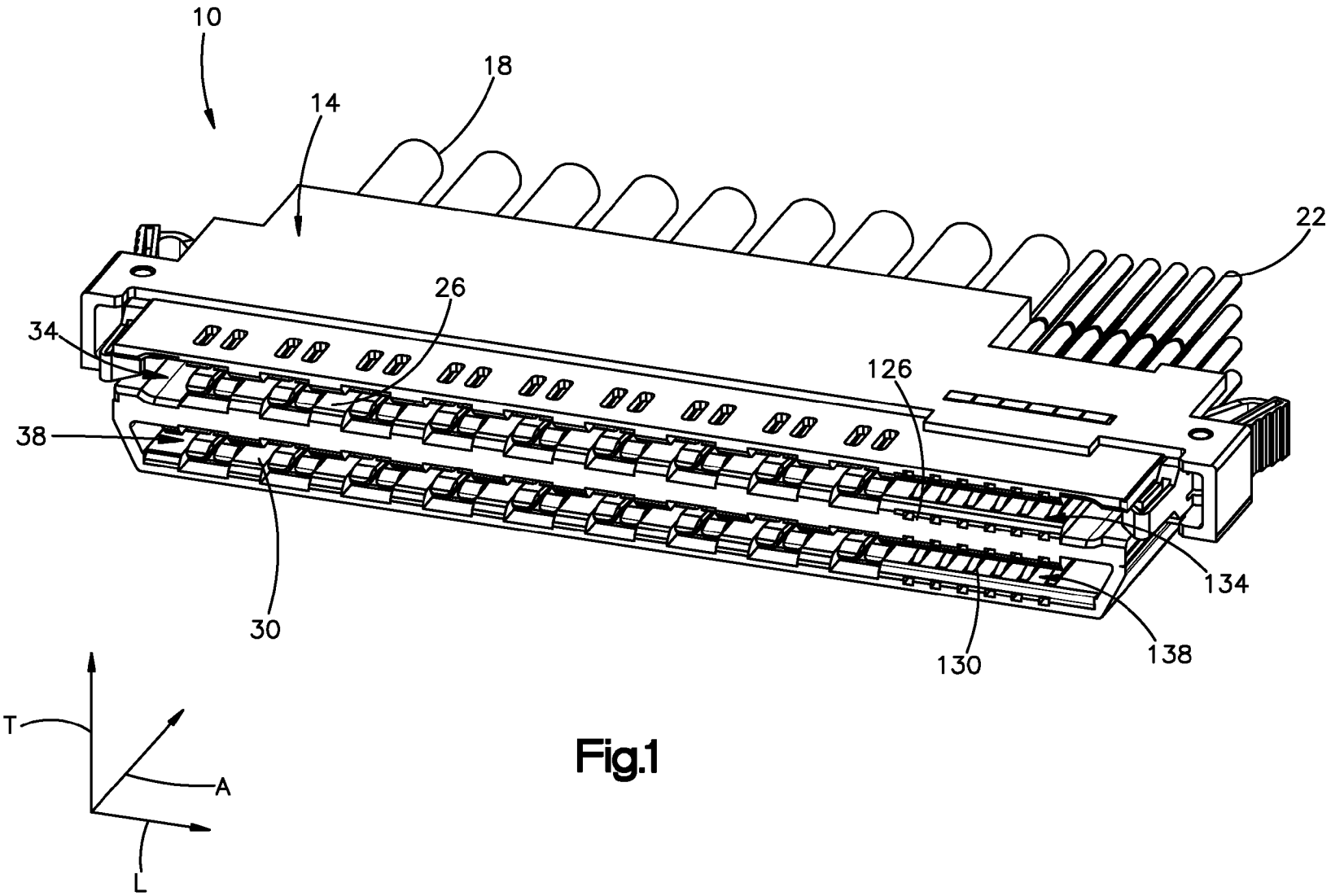
FIG. 1 is a perspective view of an electrical power connector including a housing, a plurality of power cable assemblies supported by the housing, and a plurality of signal cable assemblies supported by the housing.

Referring to FIG. 1, an electrical power connector 10, illustrated as a receptacle power connector, includes a connector housing 14 that extends horizontally along a longitudinal direction "L" that defines a length of the housing 14, and a lateral direction "A" that defines a width of the housing 14, and vertically along a transverse direction "T" that defines a height of the housing 14. The housing 14 is elongate along the longitudinal direction L. Unless otherwise specified herein, the terms "lateral," "longitudinal," and "transverse" are used to describe the orthogonal directional components of the electrical connector 10 and its components. The terms "inner" and "outer," and "above" and "below" and derivatives thereof as used with respect to a specified directional component of a given apparatus are intended to refer to directions along the directional component toward and away from the geometric center of the apparatus, unless otherwise indicated.

It should be appreciated that while the longitudinal and lateral directions are illustrated as extending along a horizontal plane and that the transverse direction is illustrated as extending along a vertical plane, the planes that encompass the various directions may differ during use, depending, for instance, on the desired orientation of the electrical connector 10. Accordingly, the terms "vertical" and "horizontal" are used to describe the electrical connector 10 as illustrated merely for the purposes of clarity and convenience, it being appreciated that these orientations may change during use.

As shown in FIG. 1, the electrical connector 10 further includes a plurality of electrical power contact assemblies 18, illustrated as power cable assemblies, and a plurality of signal contacts 22, illustrated as signal cable assemblies that are supported by the housing 14. The connector housing 14 can be two tiered and is configured to support a first or upper level 26 of power contact assemblies 18, and a second or lower level 30 of power contact assemblies 18. In the illustrated embodiment, the housing 14 is configured to support nine power contact assemblies 18 in each level 26 and 30. Therefore, the housing 14 is configured to support eighteen power contact assemblies 18. It should be understood, however, that the housing 14, may be configured to support any number of power contact assemblies 18, as desired. As shown, the first and second levels 26 and 30 define two longitudinal rows of power contact assemblies 18. In other words the first level 26 defines a first longitudinal row 34 of power contact assemblies 18, and the second level 30 defines a second longitudinal row 38 of power contact assemblies 18. The first longitudinal row 34 can be disposed above the second longitudinal row 38, as illustrated, and can be referred to as a "top" or "upper" row, while the second longitudinal row 38 can be referred to as a "bottom" or "lower" row. Thus, the first longitudinal row 34 of power contact assemblies 18 can be referred to as "top" power contacts, while the second longitudinal row 38 of power contact assemblies 18 can be referred to as "bottom" power contacts.

Figure 2A:
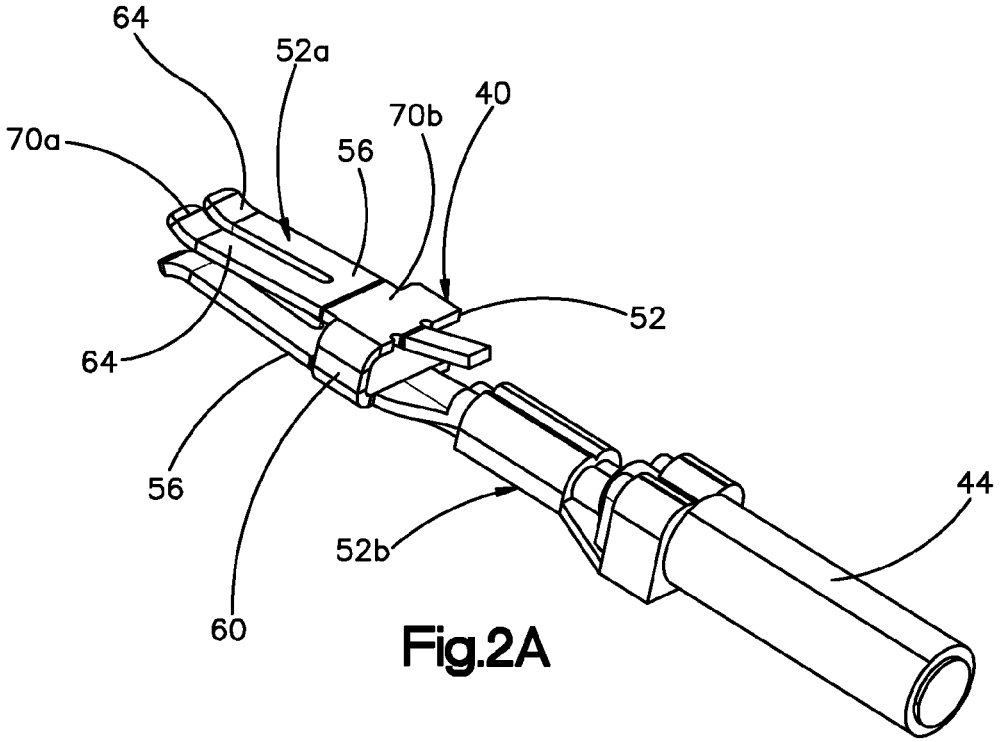
FIG. 2A is a top perspective view of a power cable assembly of the power connector shown in FIG. 1, the power cable assembly including a power cable, and a power contact portion coupled to the power cable.
Figure 2B:
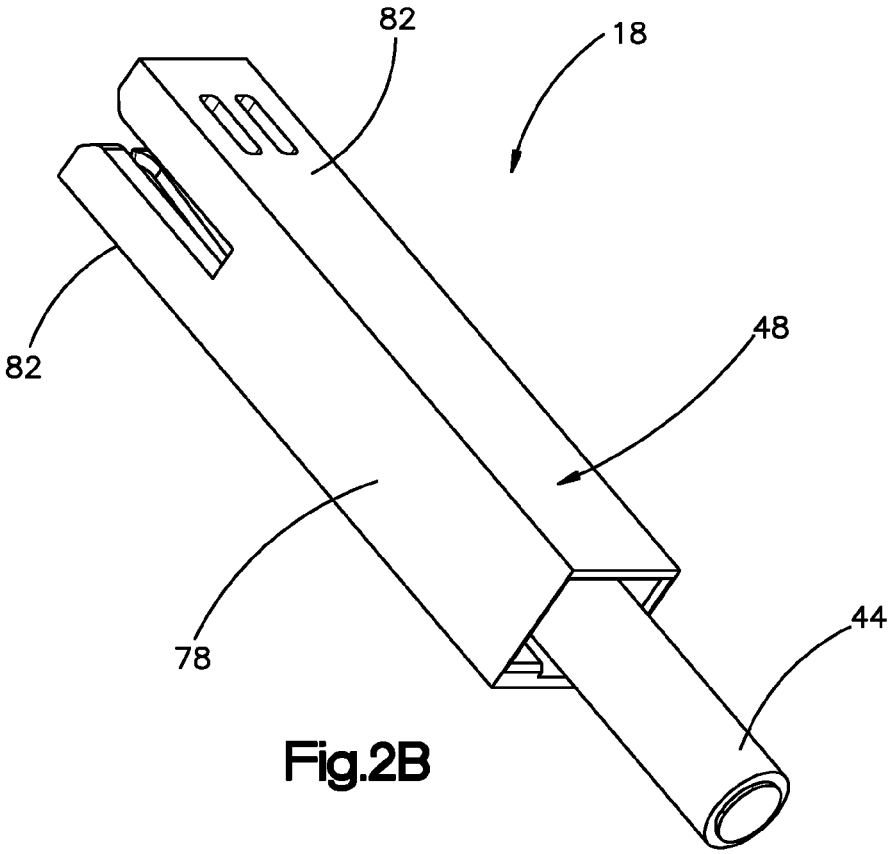
FIG. 2B is a top perspective view of the power cable assembly shown in FIG. 2A further including a power cable retainer disposed over the power contact portion.

As shown in FIGS. 2A and 2B, each power contact assembly 18 can include an electrical power contact 40, a power cable 44 that is coupled to the power contact 40, and a contact retainer 48 that carries the power contact 40 and cable 44. The power contact 40 can include a contact body 52 that defines a contact end 52*a* and an opposed crimping end 52*b*. The contact end 52*a* of the contact body 52 can define upper and lower mating ends 56 spaced apart from each other along the transverse direction T and are connected to one another by a conductive strap 60. Each mating end 56 defines a pair of resilient contact beams 64 spaced apart from each other along the longitudinal direction L. Therefore, the power contact assemblies 18 may be said to define first, second, third and fourth rows of contact beams 64 when supported in the upper and lower tiers. That is, the first row of power contact assemblies 18 may define first and second rows of contact beams, and the second row of power contact assemblies 18 may define third and fourth rows of contact beams. The contact beams 64 of the upper mating ends 56 angle toward the contact beams 64 of the lower mating ends 56, and the contact beams 64 of the lower mating ends 56 angle toward the contact beams 64 of the upper mating ends 56. Therefore, the upper and lower contact beams 64 are spaced further apart from each other at their back ends 70*b* as compared to the spacing between the upper and lower contact beams 64 at their front ends 70*a*. The crimping end 52*b* of the contact body 52 can be crimped to a non-insulated end of the power cable 44.

The power contact 40 and a portion of the cable 44 of the illustrated electrical power contact assembly 18 are disposed within the contact retainer 48. The power contact 40 and the portion of the cable 44 can be stitched into the contact retainer 48, the contact retainer 48 can be overmolded onto the power contact 40 and cable 44, or the power contact 40 and cable 44 can be otherwise affixed within the contact retainer 48, as desired. The contact retainer 48 includes a body 78 that at least partially encloses the power contact 40 and cable 44. The contact retainer 48 further includes upper and lower retainer arms 82 that extend forward from the body 78 along the lateral direction A. Each retainer arm 82 defines a slot that is open to the interior of the retainer arm 82 and is sized such that the contact beams 64 of a respective mating end 56 disposed within the retainer arm 82 will protrude outwardly from the slot. The retainer arms 82 are spaced apart from each other along the transverse direction T, thereby defining at least a portion of a connector mating interface of the electrical connector 10.

Referring back to FIG. 1, the connector housing 14 is also configured to support a first or upper level 126 of signal contacts 22, and a second or lower level 130 of signal contacts 22. In the illustrated embodiment, the housing 14 is configured to support six signal contacts 22 in each level 126 and 130. Therefore, the housing 14 is configured to support twelve signal contacts 22. It should be understood, however, that the housing 14, may be configured to support any number of signal contacts 22, as desired. As shown, the first and second levels 126 and 130 define two longitudinal rows of signal contacts 22. In other words the first level 126 defines a first longitudinal row 134 of signal contacts 22, and the second level 130 defines a second longitudinal row 138 of signal contacts 22. The first longitudinal row 134 can be disposed above the second longitudinal row 138, as illustrated, and can be referred to as a "top" or "upper" row, while the second longitudinal row 138 can be referred to as a "bottom" or "lower" row. Thus, the first longitudinal row 134 of signal contacts 22 can be referred to as "top" signal contacts, while the second longitudinal row 138 of signal contacts 22 can be referred to as "bottom" signal contacts.

Figure 3A:
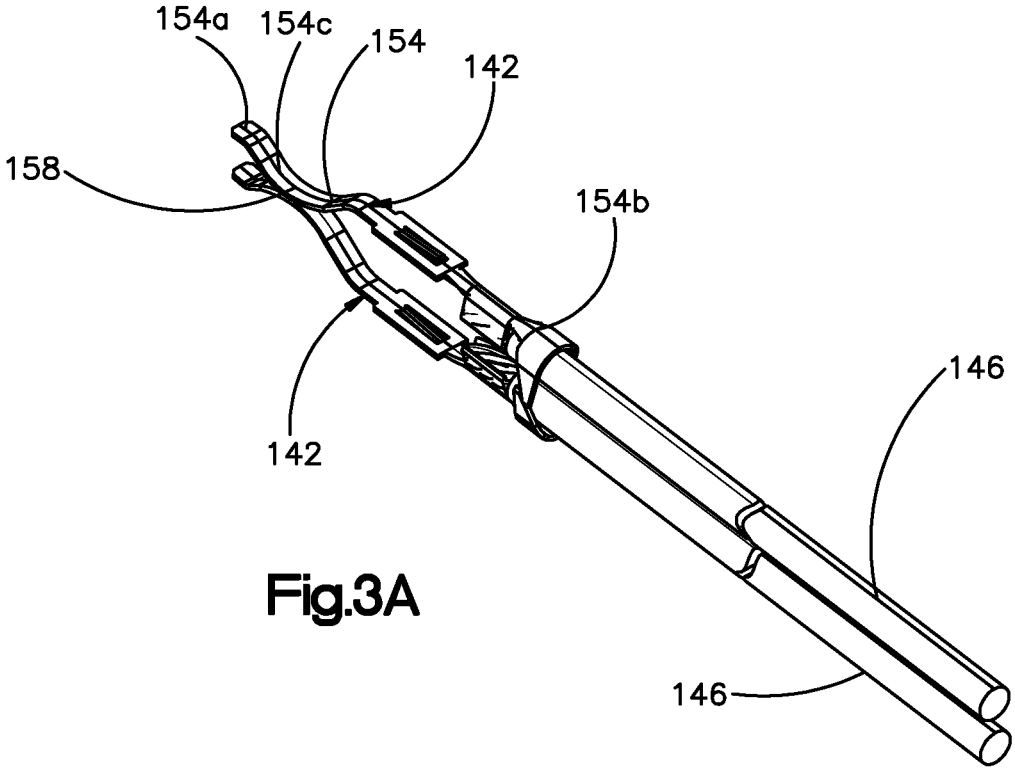
FIG. 3A is a top perspective view of a signal cable assembly of the power connector shown in FIG. 1, the signal cable assembly including a pair of signal cables and a signal contact portion coupled to the signal cables.
Figure 3B:
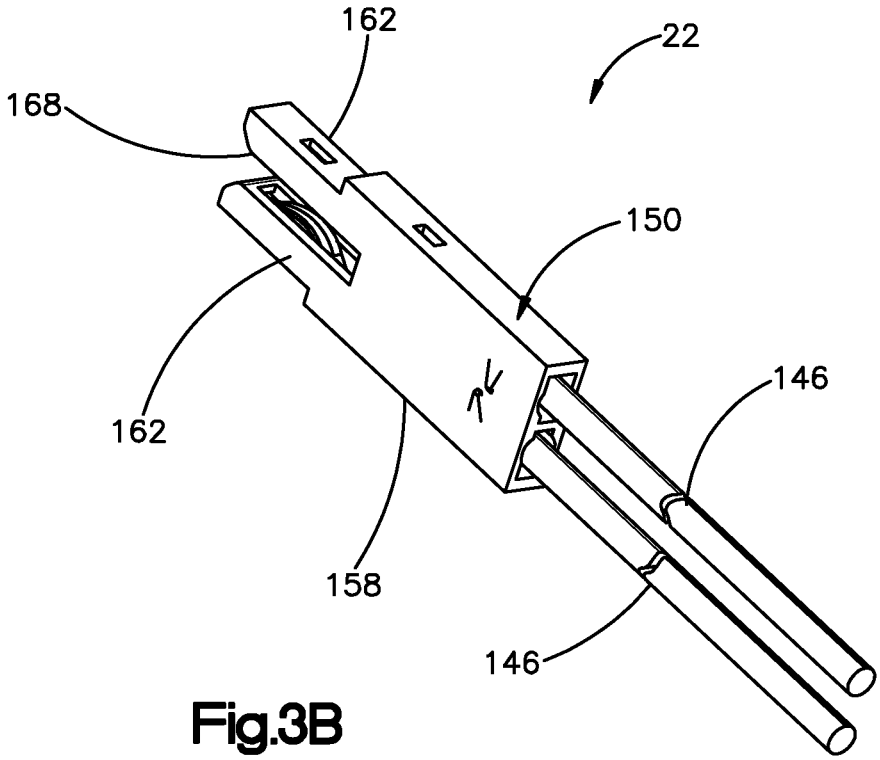
FIG. 3B is a top perspective view of the signal cable assembly shown in FIG. 3A further including a signal cable retainer disposed over the signal contact portion.

Referring now to FIGS. 3A and 3B, the electrical signal contacts 22 each include a pair of electrical signal contacts, a corresponding pair of signal cables 146 that are coupled to respective ones of the signal contacts 142, and a contact retainer 150 that carries the signal contacts 142 and a portion of the cables 146. Each signal contact 142 can include a resilient contact beam 154 that defines a mating end 154*a*, an opposed crimping end 154*b*, and an intermediate section 154*c* that extends between the mating and crimping ends 154*a*, 154*b*, respectively. The intermediate section 154*c* of each contact beam 154 can further include an inwardly bowed section 158. The crimping end 154*b* of each contact beam 154 can be crimped to a non-insulated end of a respective one of the signal cables 146.

The signal contacts 142 and cables 146 of the illustrated electrical signal contact 22 are disposed within the contact retainer 150 one above the other so as to define a column. The signal contacts 142 and cables 146 can be stitched into the contact retainer 150, the contact retainer 150 can be overmolded onto the signal contacts 142 and cables 146, or the signal contacts 142 and cables 146 can be otherwise affixed within the contact retainer 150, as desired. The contact retainer 150 includes a body 160 that at least partially encloses the signal contacts 142 and cables 146. The contact retainer 150 further includes upper and lower retainer arms 162 that extend forward from the body 160 along the lateral direction A. Each retainer arm 162 defines a slot 168 that is open to the interior of the retainer arm 162 and sized such that the bowed section 158 of the respective contact beam 154 disposed within the retainer arm 162 will protrude out from the slot 168. The retainer arms 162 are spaced apart from each other along the transverse direction T, thereby defining at least a portion of the mating interface of the electrical connector 10.

Now referring to FIGS. 4A-4F, the connector housing 14 is longitudinally elongate, and defines laterally opposing front and rear ends 226 and 228, respectively, transverse opposing upper and lower ends 232 and 236, respectively, and longitudinally opposing end walls 240 and 244, respectively. The housing 14 can be two tiered and includes a first or upper level 250 and a second or lower level 254 that is disposed below the upper level 250. All connector housings 14 are described herein as being so oriented unless otherwise specified, it being appreciated that the orientation can change during use.

The front end 226 of the upper level 250 defines a first mating interface 258, and the front end 226 of the lower level 254 defines a second mating interface 262, that are each configured to receive the mating ends of the power contacts 40. As shown, the first and second mating interfaces 258 and 262 each include nine power contacts 40. The power contacts 40 of the first mating interface 258 are vertically aligned with the power contacts 40 of the second mating interface 262.

Similarly, the front end 226 of the upper level 250 also defines a first signal mating interface 266, and the front end 226 of the lower level 254 also defines a second signal mating interface 270, that are each configured to receive the mating ends of the electrical signal contacts 142. As shown, the first and second signal mating interfaces 266 and 270 each include 12 signal contacts 142. The signal contacts 142 of the first signal mating interface 266 are vertically aligned with the signal contacts 142 of the second signal mating interface 170. Because the front end defines the first and second mating interfaces 258 and 262, and the first and second signal mating interfaces 266 and 270, it can be said that the front end 226 defines a connector mating interface 280.

Figure 4A:
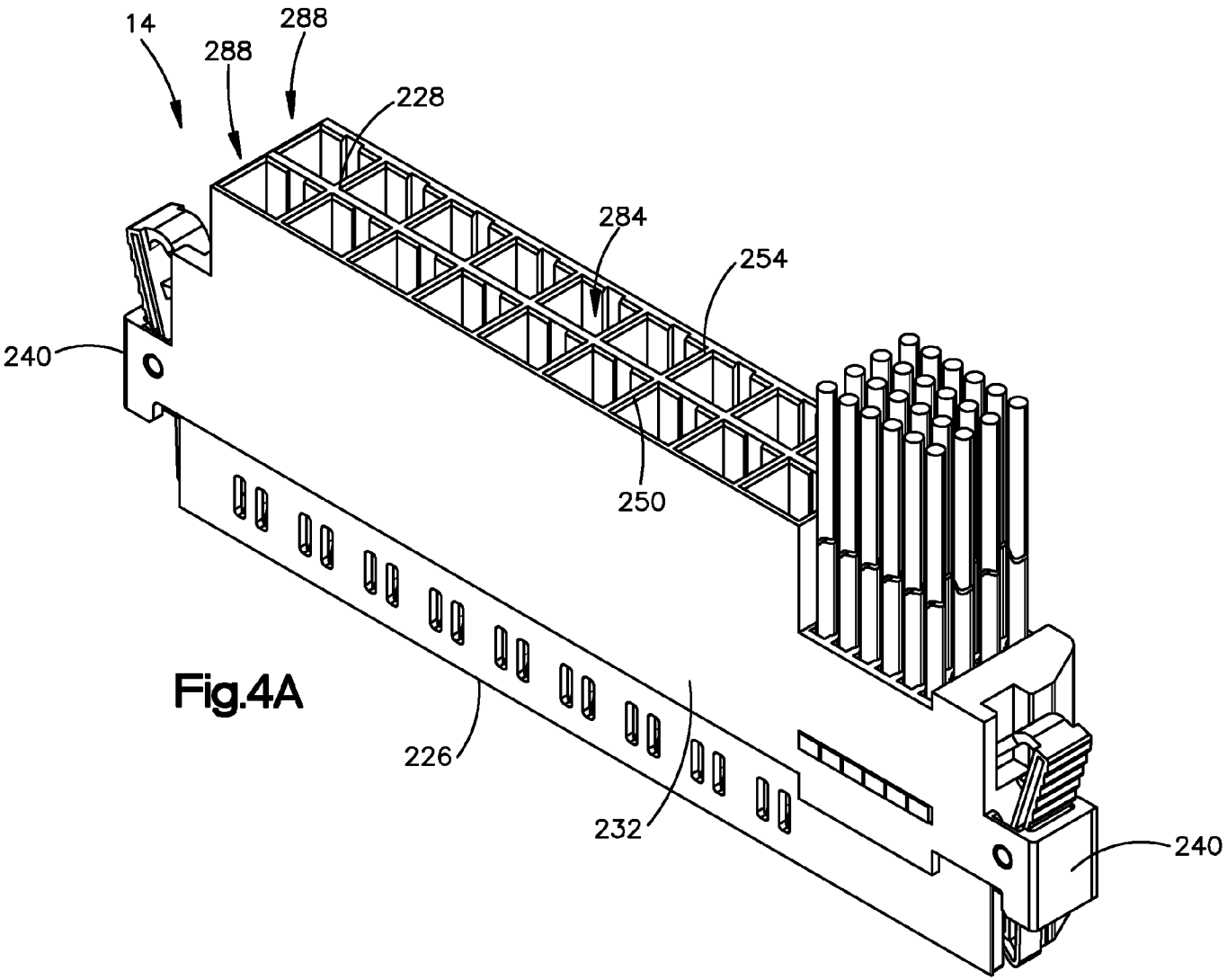
FIG. 4A is a top perspective view of the power connector shown in FIG. 1 with the power cables removed for clarity.

As shown in FIG. 4A, the rear end 228 defines a plurality of assembly receptacles 284 that are configured to receive a respective power contact assembly 18. The receptacles 284 are longitudinally aligned within each level 250 and 254 so as to define first and second rows 288 of receptacles 284. The receptacles 284 of the upper level 250 are also vertically aligned with the receptacles 284 of the lower level 254.

Figure 4B:
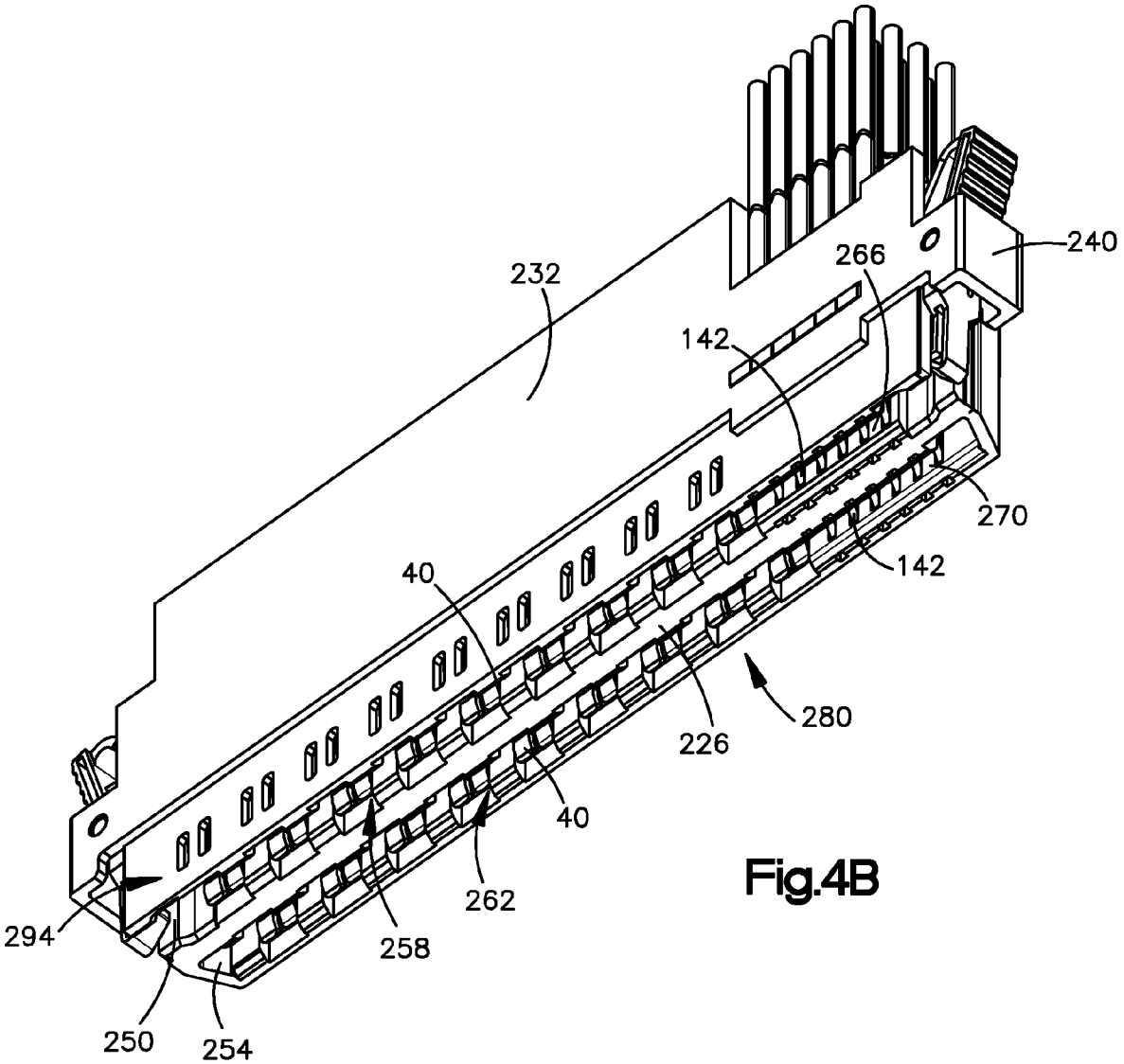
FIG. 4B is a front perspective view of the power connector shown in FIG. 4A.
Figure 4C:
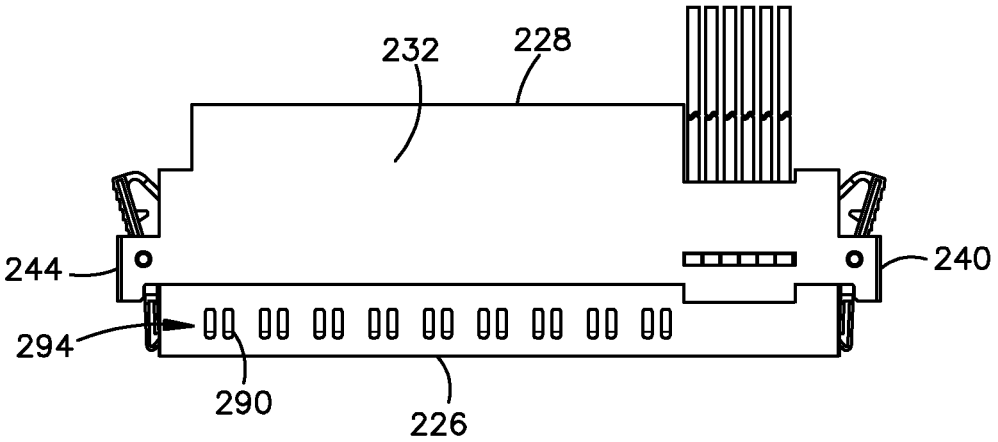
FIG. 4C is a top plan view of the power connector shown in FIG. 4A.
Figure 4D:
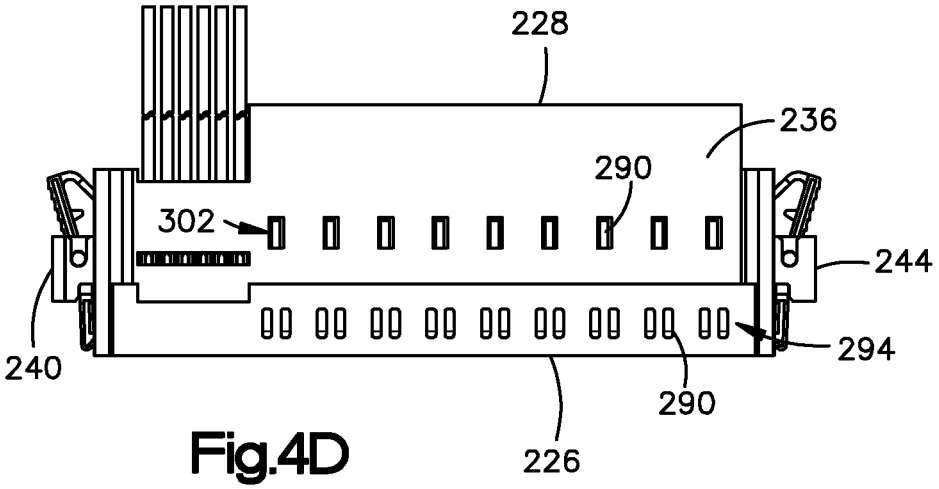
FIG. 4D is a bottom plan view of the power connector shown in FIG. 4A.
Figure 4E:
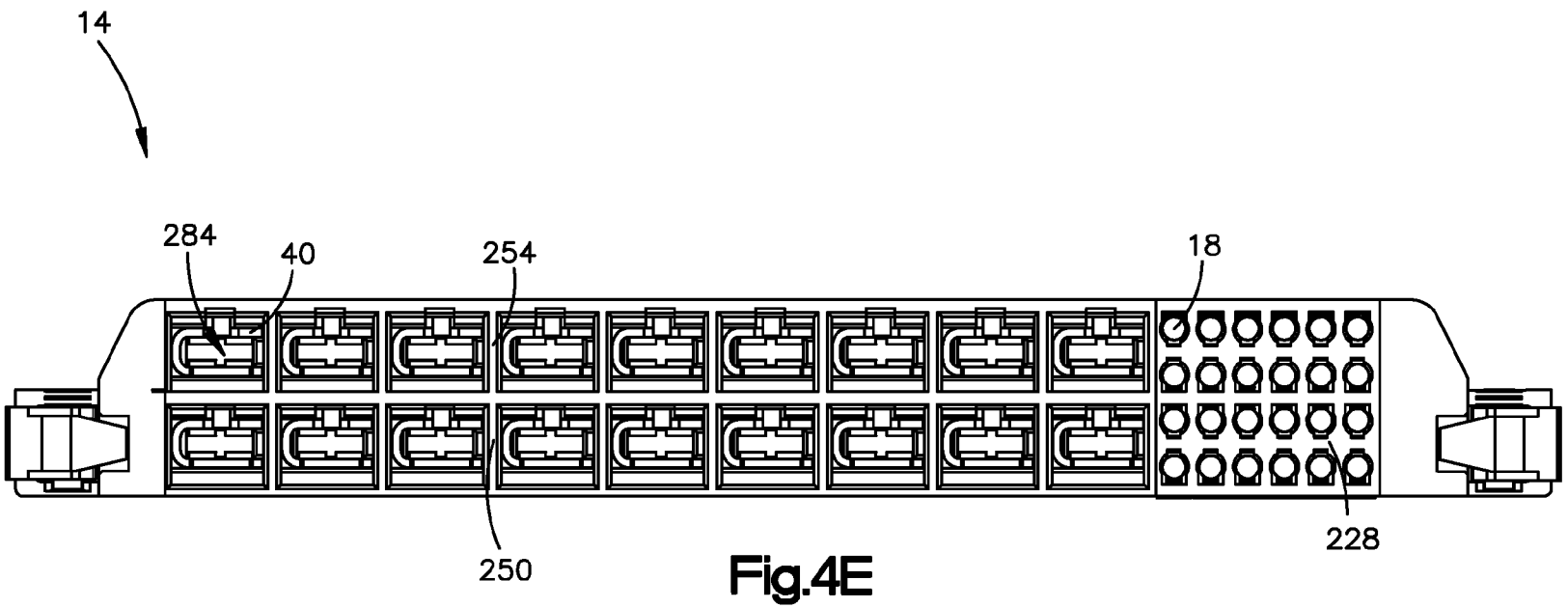
FIG. 4E is a back elevation view of the power connector shown in FIG. 4A.

As shown in FIGS. 4C-4D, the upper and lower ends 232 and 236 of the housing 14 include longitudinally extending rows of ventilation windows 290 that extend vertically therethrough. In particular, the upper and lower ends 232 and 236 each include a first row 294 of ventilation windows 290 that are laterally elongate, and extend transversely through the upper and lower ends 232 and 236, such that the windows 290 that extend through the upper end 232 are aligned with the windows 290 that extend through the lower end 236. The lower end 236 of the housing 14 further includes a second row 302 of windows 290 that are laterally offset from the first row 294 of windows 290.

Figure 4F:
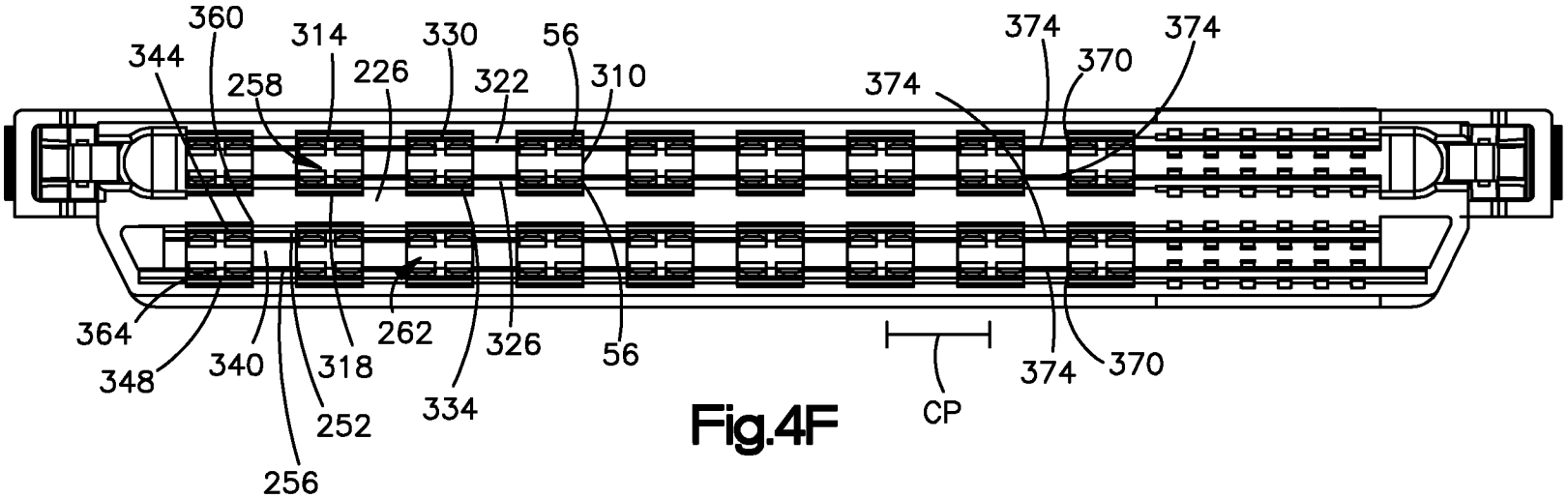
FIG. 4F is a front elevation view of the power connector shown in FIG. 4A.

As shown in FIGS. 4B and 4F, the first mating interface 258 includes a first receptacle 310 that is defined by opposing first and second walls 314 and 318. The first mating interface 258 further includes a plurality of first dividers 322 that extend from the first wall and into the first receptacle 310, and a plurality of second dividers 326 that extend from the second wall 318 and into the first receptacle 310. The first and second dividers 322 and 326 are vertically aligned with each other, and are vertically spaced from each other along a first direction such as the transverse direction T. The first dividers are longitudinally spaced or otherwise separated from each other such that upper mating end receiving portions 330 are defined between adjacent first dividers 322. Similarly, the second dividers 326 are longitudinally spaced or otherwise separated from each other such that lower mating end receiving portions 334 are defined between adjacent second dividers 326. Therefore, when the power contact assemblies 18 are supported by the housing 14, the upper and lower mating ends 56 of each power contact assembly 18 at least partially extend into the first receptacle such that the upper mating ends 56 are separated from each other by the first dividers 322, and the lower mating ends 56 are separated from each other by the second dividers 326.

Similarly, the second mating interface 262 includes a second receptacle 340 that is defined by opposing third and fourth walls 344 and 348. The second mating interface 262 further includes a plurality of third dividers 352 that extend from the third wall 344 and into the second receptacle 340, and a plurality of fourth dividers 356 that extend from the fourth wall 348 and into the second receptacle 340. The third and fourth dividers 352 and 356 are vertically aligned with each other, and are vertically spaced from each other along a first direction, such as the transverse direction. The third dividers 352 are longitudinally spaced or otherwise separated from each other such that upper mating end receiving portions 360 are defined between adjacent third dividers 352. Similarly, the fourth dividers 356 are longitudinally spaced or otherwise separated from each other such that lower mating end receiving portions 364 are defined between adjacent fourth dividers 356. Therefore, when the power contact assemblies 18 are supported by the housing 14, the upper and lower mating ends 56 of each power contact assembly 18 at least partially extend into the second receptacle 340 such that the upper mating ends 56 are separated from each other by the third dividers 352, and the lower mating ends 56 are separated from each other by the fourth dividers 356.

Figure 4G:
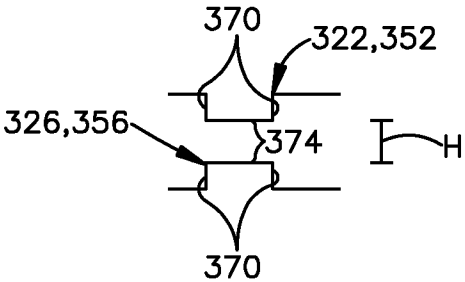
FIG. 4G is a detailed view of example dividers that separate adjacent power contacts from each other.
Figure 5A:
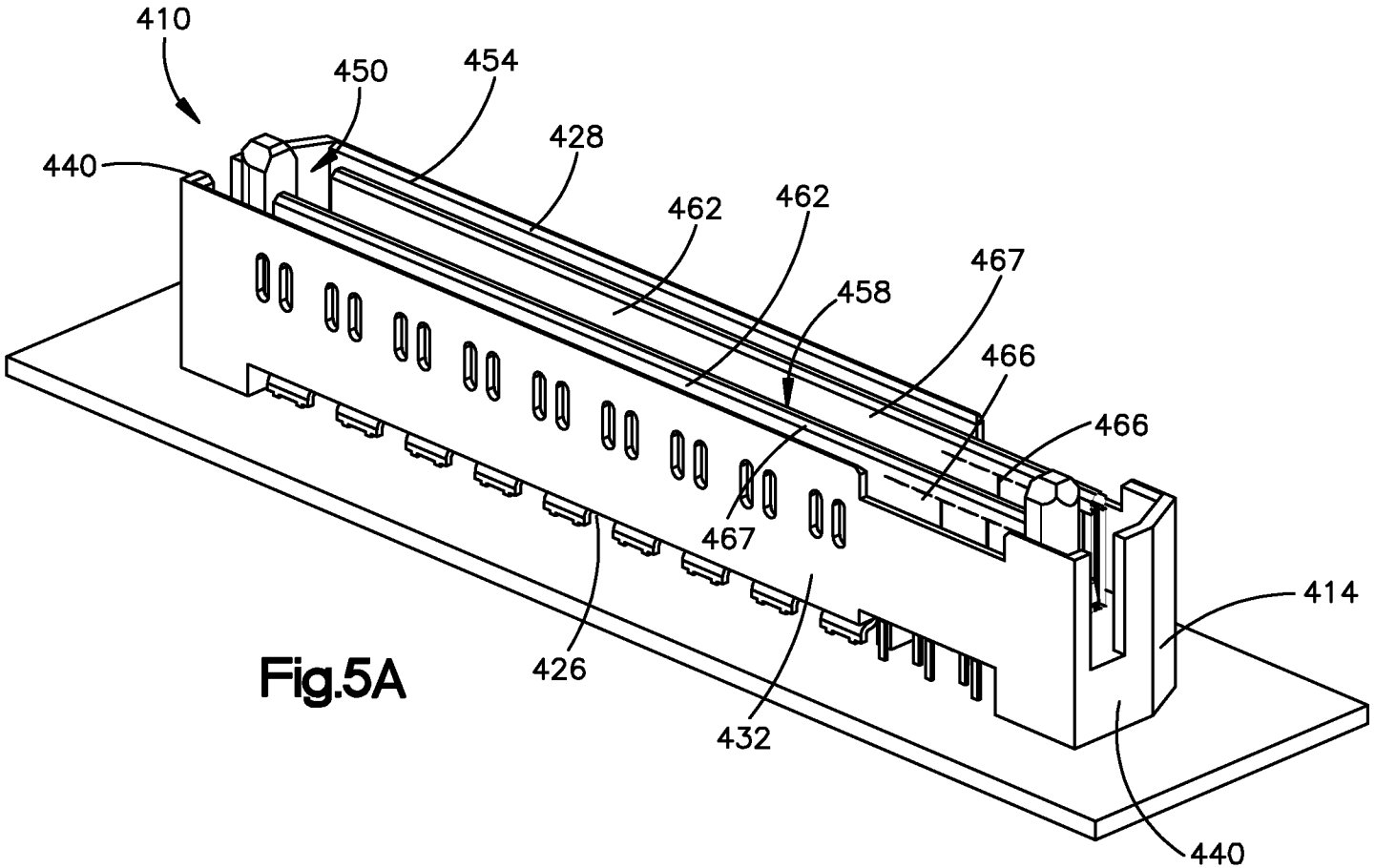
FIG. 5A is a perspective view of a vertical header connector configured to mate with the power connector shown in FIG. 1.
Figure 5D:
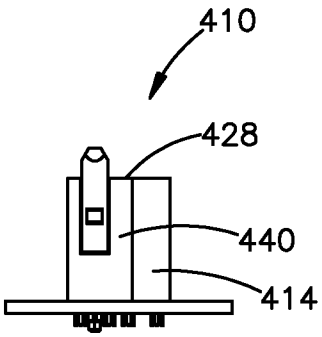
FIG. 5D is a side elevation view of the vertical header connector shown in FIG. 5A.
Figure 5B:
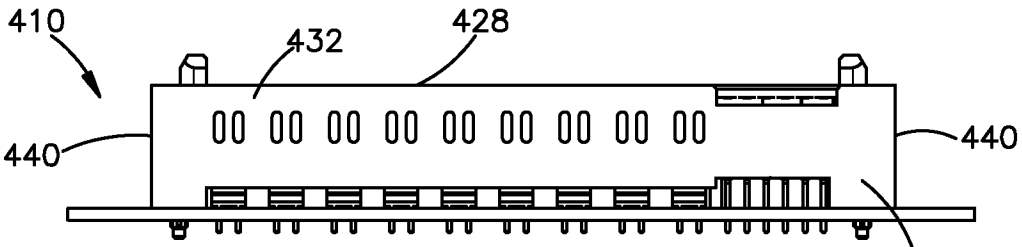
FIG. 5B is a to plan view of the vertical header connector shown in FIG. 5A.
Figure 5C:
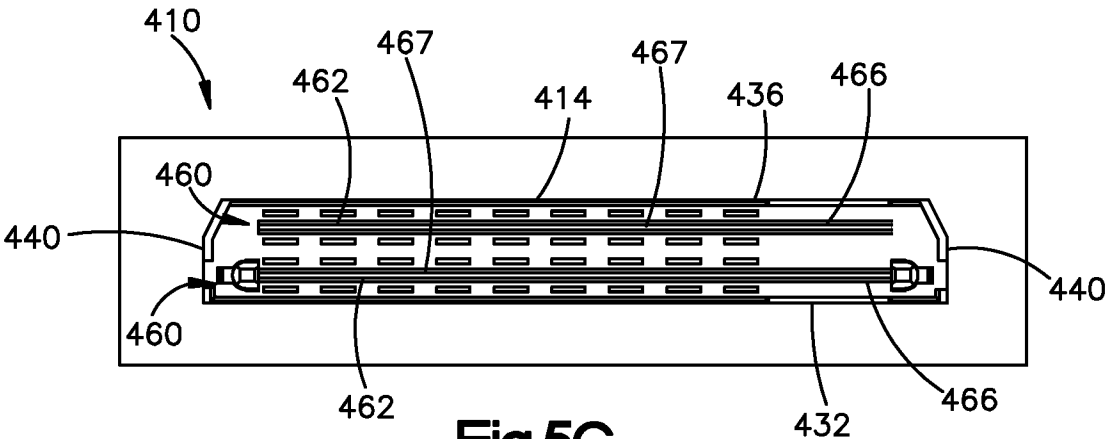
FIG. 5C is a back elevation view of the vertical header connector shown in FIG. 5A.

With continued reference to FIGS. 4F and 4G, the first, second, third and fourth dividers 322, 326, 352, and 356, respectively, each define a pair of side surfaces 370 that are joined by an inner surface 374. The inner surface 374 of each divider can have a longitudinal length that is greater than a transverse height of the side surfaces 370. The transverse height of the side surfaces 370 and the longitudinal length of the inner surface 374 for each divider is such that a minimum creep distance between adjacent upper mating ends 56, (and also between adjacent lower mating ends) is between about 1.0 mm and about 5.0 mm. That is, the distance from adjacent upper mating ends 56 (or adjacent lower mating ends 56) at least partially taken along at least a portion of each surface of the side surfaces 370 and along the inner surface 374 of the respective dividers is between about 1.0 mm and about 5.0 mm. In the illustrated embodiment, the minimum creep distance between adjacent upper mating ends 56 (and also between adjacent lower mating ends 56) is about 3.2 mm. It should be understood, however, that the creep distance may be varied as desired. For example, the minimum creep distance can be between about 2.0 mm and about 4.0 mm. Moreover, the transverse height of the side surfaces 370 is such that the electrical connector 10 can be mated with a standard header connector without any modifications to the standard header connector. In other words, a transverse distance H defined between the first dividers 322 and the second dividers 326 (and between the third dividers 352 and the fourth dividers 356) is no less than a maximum thickness of a contact bar of a standard header connector so as to not impede mating of the electrical connector 10 with a standard header connector.

Furthermore, it can be said that the first, second, third, and fourth dividers 322, 326, 352, and 356 comprise a first material, such as an electrically nonconductive plastic, for instance a polyamide resin, that has a first dielectric constant. It can further be said that the electrical connector 10 further defines a region that comprises a second material, for instance air, that is disposed adjacent the respective dividers 322, 326, 352, and 356 and defines a second dielectric constant that is less than the first dielectric constant. For instance, the second material can be disposed between and adjacent (along the longitudinal direction L) adjacent ones of one or more up to all of the dividers 322, 326, 352, and 356. Furthermore, the second material can be disposed adjacent (along the transverse direction T) one or more up to all of the dividers 322, 326, 352, and 356. It should be appreciated that air at 20° C. has a dielectric constant of one and that in one embodiment the dividers are made of a polyamide resin which has a dielectric constant of 3.7 at 20° C. It should also be appreciated, that the dividers can be made of any material as desired, and that such material will have a dielectric constant that is greater than 1 at 20° C.

In accordance with the illustrated embodiment, the first and second materials are adjacent to each other such that no additional material, that is different than the first and second materials, is disposed between the first and second materials, though it should be appreciated in accordance with certain embodiments that one or more additional materials different than the first and second materials can be disposed between the first and second materials. Therefore it can be said that the minimum distance between adjacent power contacts taken through only the region and at least partially along a border defined between the dividers and the regions is between about 1.0 mm and about 5.0 mm.

It can also be said that the connector 10 defines a shortest distance between the first and second successive ones of (e.g. adjacent) power contacts, the shortest distance being measured at least partially along the outer surface of the select one of the dividers 322, 326, 352, and 356 and only in the region such that no other distance measured between the first and second successive ones of the power contacts at least partially along the outer surface of the select one of the dividers 322, 326, 352, and 356 and only in the region is shorter than the shortest distance which can be between about 1.0 mm and about 5.0 mm and in some embodiment between about 2.0 mm and about 4.0 mm.

The power contact assemblies 18 can be mounted within the housing 14 such that the mating ends 56 are arranged in rows and columns. For example, in the illustrated embodiment, mating ends 56 are arranged in four rows and 9 columns. Though it should be appreciated that the mating ends can be arranged in any number of rows and any number of columns as desired.

The first and second rows of power contact assemblies 18 or at least the mating ends can be arranged in rows so as to have a column contact pitch CP that is between about 7.0 mm and about 8.0 mm. That is the mating ends can be spaced from each other along a second direction such as the longitudinal direction such that a contact pitch measured along the longitudinal direction between respective centers of adjacent mating ends 56 can be between about 7.0 mm and about 8.0 mm. In the illustrated embodiment, the mating ends have a contact pitch CP of about 7.6 mm. It should be appreciated that the contact pitch CP is measured from a center of a first mating end 56 to a center of a second adjacent mating end of the same row.

It has been found that the electrical connector 10 may have a maximum working voltage which is a function of a comparative tracking index "CTI", minimum creepage distance between two immediately adjacent power contacts, and the pollution degree. CTI testing is specified in the IEC standard 60112. The maximum voltage can be carried between the respective mounting ends and mating ends of adjacent ones of the contacts, for instance along first and second contacts that are adjacent each other along a row of contacts, without causing current to flow from the first contact to the second contact, such as from the mating end of the first contact to the mating end of the second contact, through the dielectric that separates the second contact from the first contact. The dielectric can include a portion of the housing, such as one of the dividers, or the region that has the second dielectric constant of reduced dielectric constant, such as air, or a combination thereof.

In the illustrated embodiments, the maximum working voltage is greater than 100 V, such as greater than 400 V. That is, the electrical connector 10 can have a voltage that is greater than 100 V, such as greater than 400 V that can be carried by each of the first and second successive contacts, without the voltage traveling from the first contact to the second contact across the region of lesser dielectric constant, such as air. For example, the electrical connector 10 may have a maximum working voltage of about 630V AC (890V DC) at a minimum creepage distance of about 3.2 mm, a pollution degree of two, and material rated as Group One (CTI is greater than or equal to 600V) by Underwriter Laboratories, Inc. (see Table 2N of UL Certification 60950-1, Edition Two). It has also been found that such an electrical connector 10 may have a linear current density of about 200 A/inch, and a linear power density of at least 60 KW. In the illustrated embodiment, the electrical connector 10 has a linear power density of about 126 KW (or 178 KW for DC). It is noted that any interval integer or decimal voltage between or including 110 to 630V AC, 200 to 630V AC, 300 to 630V AC, or 400 to 630 V AC is contemplated by the present invention.

The electrical connector 10 may be mated with a header connector such as header connector 410 shown in FIGS. 5A-5D. The header connector 410 may be a standard header connector. Header connector 410 is illustrated as a vertical header connector, though it should be understood that the header connector 410 may have other configurations. For example, the header connector 410 may be configured as a right angle header connector. As shown, the header connector 410 includes a header connector housing 414 having a front end 426, a rear end 428, an upper end 432, a lower end 436, and opposing side ends 440.

Like the electrical connector 10, the header connector 410 can be two tiered. As shown, the rear end 428 provides a mating end 450 that defines a shroud 454 sized to receive the front end of the electrical connector 10. The shroud 454 defines a receptacle 458 that is configured to receive first and second (or upper and lower) rows 460 of plug contacts 462 and signal blade contacts 466. Each row 460 of plug contacts 462 and signal blade contacts 466 extends through a respective tier of the header connector 410. Each row 460 of plug contacts 462 and signal blade contacts 466 may at least partially define a respective contact bar 467. Each contact bar 467 is configured to be received by the mating interfaces 258 and 262, respectively, of the electrical connector 10. The contact bars 467 have a transverse height "C". The transverse height C may be the same as that found on a standard header connector.

The header connector housing 414 can have a longitudinal length that is between about 90 and about 110 mm, such as a longitudinal length of about 98.6 mm. The header connector housing 414 may also have a transverse height that is between about 10 and about 15 mm, such as about 13.6 mm. Though it should be appreciated that the header connector housing 414 can have any dimensions as desired.

Figure 6A:
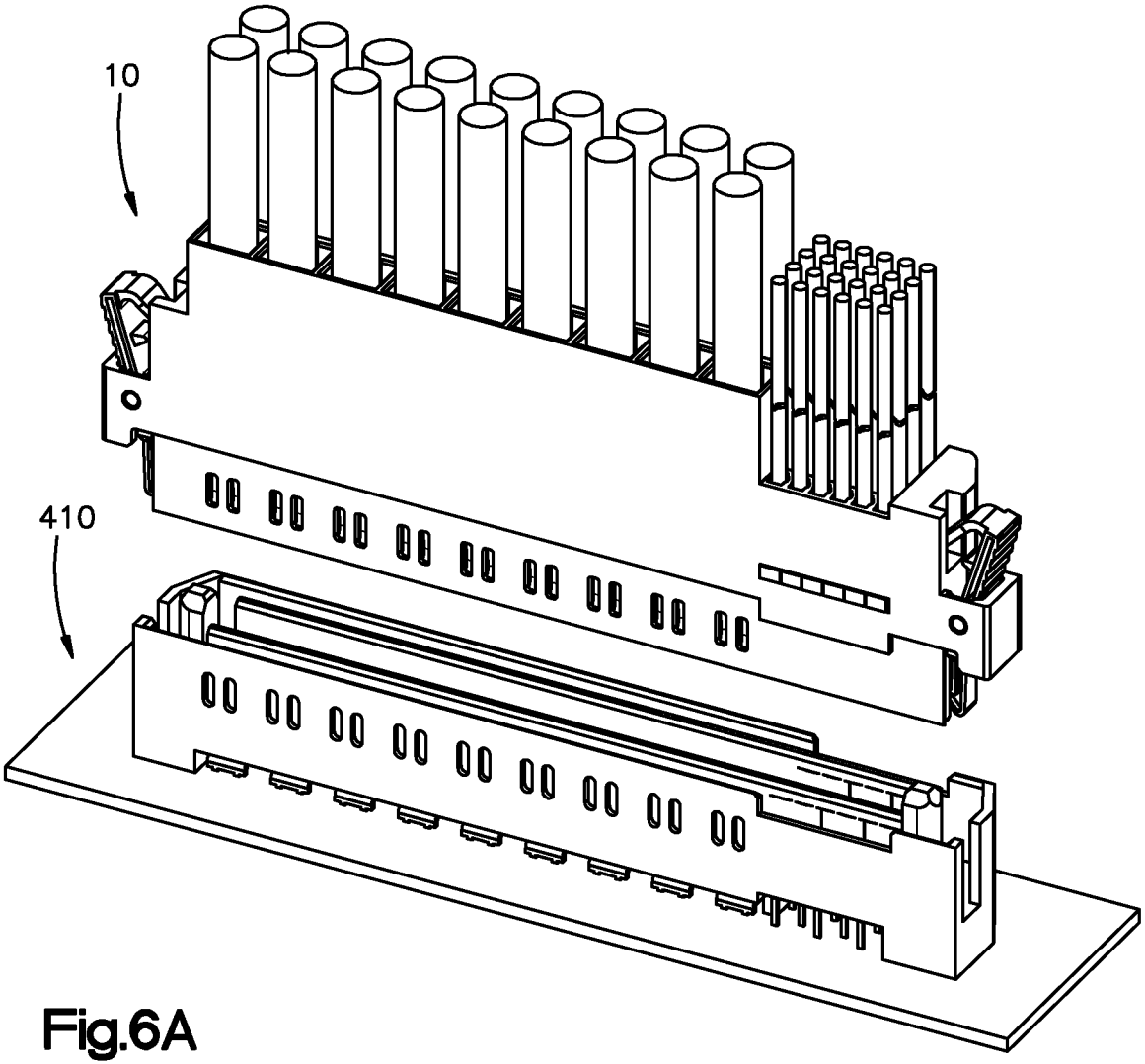
FIG. 6A is a perspective view of the power connector shown in FIG. 1 being mated with the vertical header connector shown in FIG. 5A.
Figure 6B:
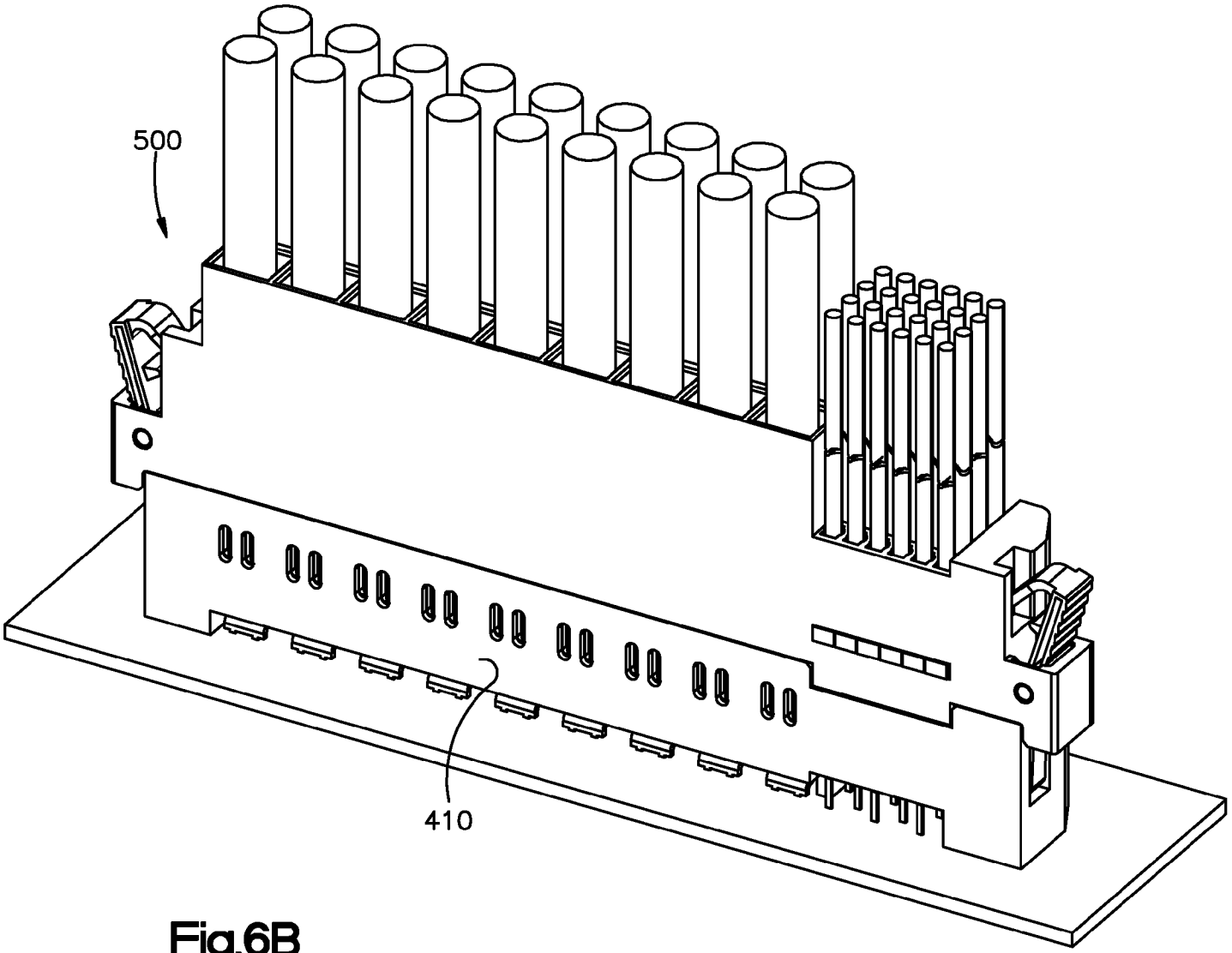
FIG. 6B is a perspective view of the power connector fully mated with the vertical header connector.

Now referring to FIGS. 6A and 6B, the electrical connector 10 can be mated with the header connector 410 to form a power connector assembly 500. As shown, the upper row 460 of plug contacts 462 and signal blade contacts 466 are received by the power contacts 40 of the upper level 26 of power contacts 40 of the electrical connector 10, and the lower row 460 of plug contacts 462 and signal blade contacts 466 are received by the power contacts 40 of the lower level 30 of power contacts 40 of the electrical connector 10, when the electrical connectors 10 and 410 are fully mated. As shown, the dividers 322, 326, 352, and 356 do not interfere with the plug contacts 462 and signal blade contacts 466 so as to prevent the electrical connectors 10 and 410 from mating.

Figure 7A:
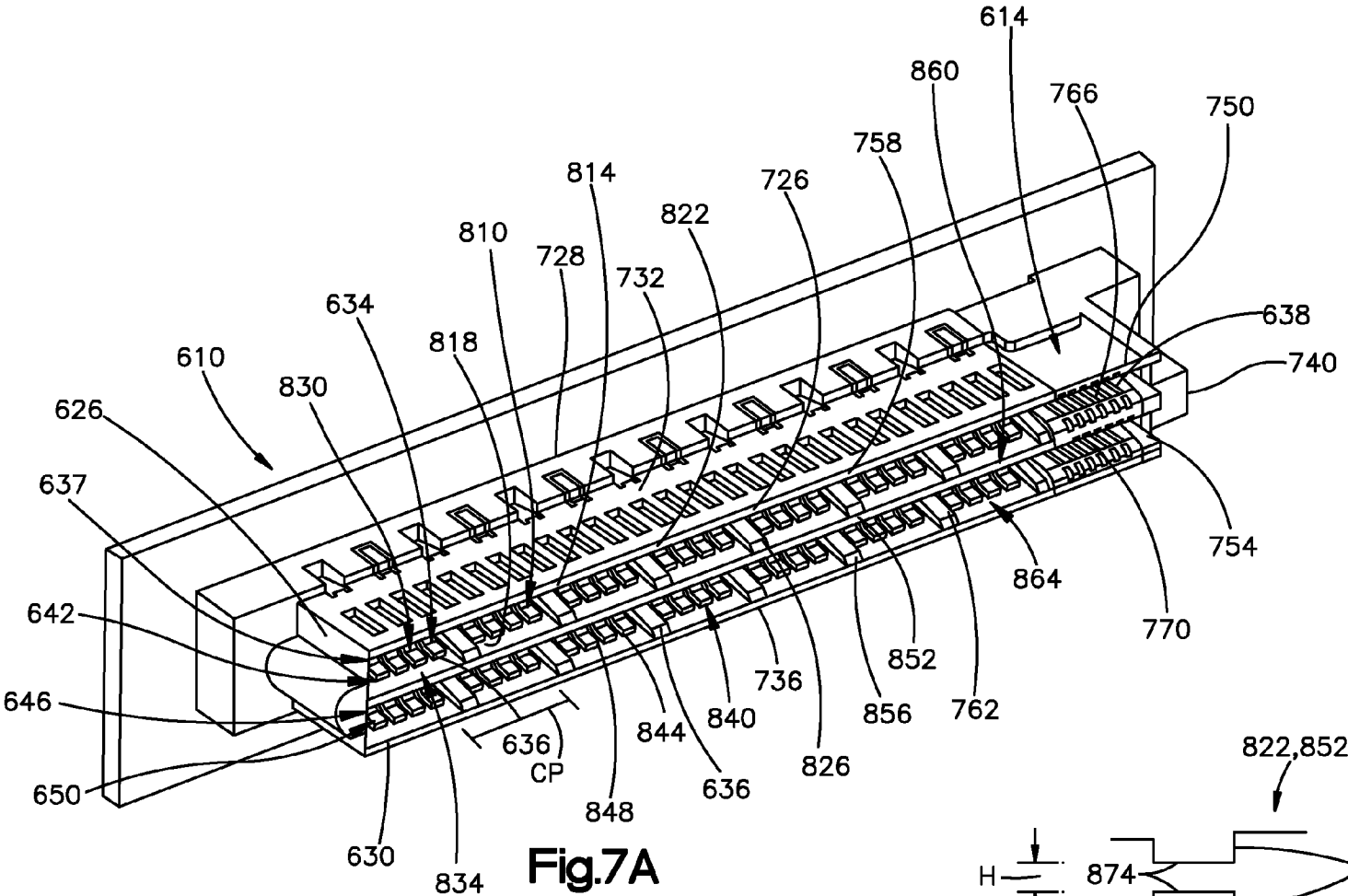
FIG. 7A is a perspective view an electrical power connector in accordance with another embodiment, the power connector being configured to provide a board to board connector assembly.
Figure 7B:
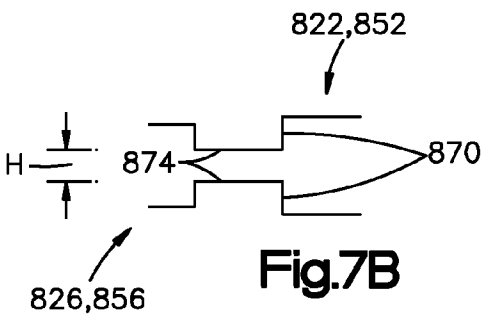
FIG. 7B is a detailed view of example dividers that separate adjacent power contacts from each other.

In another embodiment and in reference to FIGS. 7A and 7B, the power connector may be configured so as to provide a board to board connector assembly as opposed to a cable connector assembly as shown in FIGS. 6A and 6B. As shown in FIGS. 7A and 7B, an electrical power connector 610, illustrated as a receptacle power connector, can include a connector housing 614, a plurality of first and second power receptacle contacts 634 and 636 supported by the housing 614, and a plurality of signal contacts 638 supported by the housing 614. The power connector 610 is constructed substantially identical with respect to electrical connector 10 unless otherwise indicated. The connector housing 614 can be two tiered and is configured to support a first or upper level 626 of first and second power contacts 634 and 636, and a second or lower level 630 of first and second power contacts 634 and 636. As shown, the first and second levels 626 and 630 define four longitudinal rows of power contacts. In other words, the first level 626 defines a first longitudinal row 637 of first power contacts 634 and a second longitudinal row 642 of second power contacts, and the second level 630 defines a third longitudinal row 646 of first power contacts 634 and a fourth longitudinal row 650 of second power contacts 636.

Figure 8:
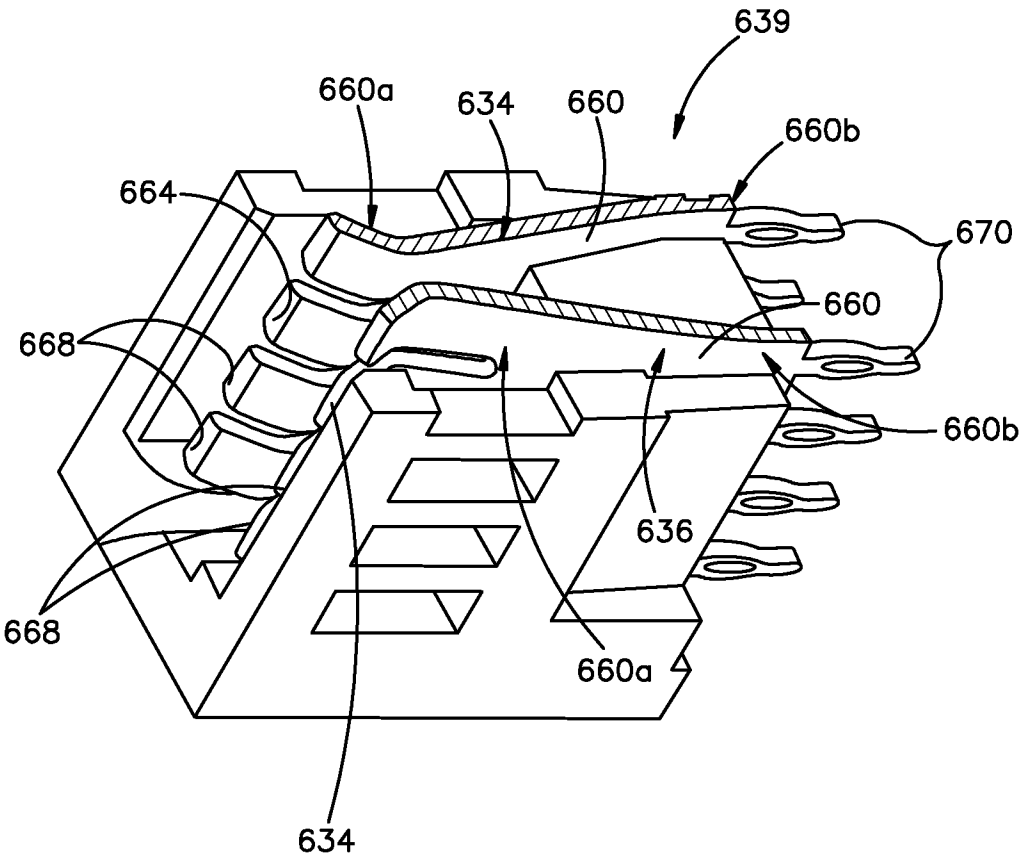
FIG. 8 is a detailed view of first and second power contacts of the connector shown in FIG. 7A.

As shown, the second and fourth rows 642 and 650 of second power contacts 636 are supported by the housing 614 at a location spaced from the first and second rows 626 and 646, respectively, of first power contacts 634. Therefore, each first power contact 634 faces an opposing second power contact 636 as shown in FIG. 8. The opposing first and second power contacts 634 and 636 can together define a power contact 639. As shown in FIG. 8, each first and second power contact 634 and 636 can include a contact body 660 that defines a mating end 660*a* and an opposed mounting end 660*b*. Each mating end 660*a* can define contact plate 664 that defines four resilient contact beams 668 that are spaced apart from each other along the longitudinal direction L. Therefore, the first row of power contacts 634 can be said to define a first row of contact beams, the second row of power contacts 636 can be said to define a second row of contact beams, the third row of power contacts 636 can be said to define a third row of contact beams, and the fourth row of power contacts can be said to define a fourth row of contact beams. The contact plates 664 for the first power contacts 634 may be referred to as upper mating ends and the contact plates 664 for the second power contacts 636 may be referred to as lower mating ends. The mounting end 660*b* of each power contact defines tails 670 that are configured to be mounted to a printed circuit board. While the power contacts are configured for a vertical connector, it should be understood, that the power contacts, may also have other configurations, such as for a right angle connector.

Referring back to FIG. 7A, the connector housing 614 is longitudinally elongate, and defines laterally opposing front and rear ends 726 and 728, respectively, transverse opposing upper and lower ends 732 and 736, respectively, and longitudinally opposing end walls 740 and 744, respectively. The housing 614 is two tiered and includes a first or upper level 750 and a second or lower level 754 that is disposed below the upper level 750.

The front end 726 of the upper level 750 defines a first mating interface 758, and the front end 726 of the lower level 754 defines a second mating interface 762, that are each configured to receive the mating ends of the first and second power contacts 634 and 636. As shown, the first and second mating interfaces 758 and 762 each include six first power contacts 634, and six second power contacts 636. It can also be said that each mating interface includes six power contacts 639. The first and second power contacts 634 and 636 of the first mating interface 758 are vertically aligned with the first and second power contacts 634 and 636 of the second mating interface 762.

Similarly, the front end 726 of the upper level 750 also defines a first signal mating interface 766, and the front end 726 of the lower level 754 also defines a second signal mating interface 770, that are each configured to receive the mating ends of the electrical signal contacts 638. The signal contacts 638 of the first signal mating interface 766 are vertically aligned with the signal contacts 638 of the second signal mating interface 770. Because the front end defines the first and second mating interfaces 758 and 762, and the first and second signal mating interfaces 766 and 770, it can be said that the front end 726 defines a connector mating interface 780.

With continued reference to FIG. 7A, the first mating interface 758 includes a first receptacle 810 that is defined by opposing first and second walls 814 and 818, respectively. The first mating interface 758 further includes a plurality of first dividers 822 that extend from the first wall and into the first receptacle 810, and a plurality of second dividers 826 that extend from the second wall 818 and into the first receptacle 810. The first and second dividers 822 and 826 are vertically aligned with each other, and are vertically spaced from each other along the first or transverse direction. The first dividers are longitudinally spaced or otherwise separated from each other such that upper plate receiving portions 830 are defined between adjacent first dividers 822. Similarly, the second dividers 826 are longitudinally spaced or otherwise separated from each other such that lower plate receiving portions 834 are defined between adjacent second dividers 826. Therefore, when the first and second power contacts 634 and 636 are supported by the housing 614, the mating ends 660*a* of each power contact 634 and 636 at least partially extend into the first receptacle 810 such that the mating ends 660*a* of the first power contacts 634 are separated from each other by the first dividers 822, and the mating ends 660*a* of the second power contacts 636 are separated from each other by the second dividers 826.

Similarly, the second mating interface 762 includes a second receptacle 840 that is defined by opposing third and fourth walls 844 and 848, respectively. The second mating interface 762 further includes a plurality of third dividers 852 that extend from the third wall 844 and into the second receptacle 840, and a plurality of fourth dividers 856 that extend from the fourth wall 848 and into the second receptacle 840. The third and fourth dividers 852 and 856 are vertically aligned with each other, and are vertically spaced from each other along the first or transverse direction. The third dividers 852 are longitudinally spaced or otherwise separated from each other such that upper plate receiving portions 860 are defined between adjacent third dividers 852. Similarly, the fourth dividers 856 are longitudinally spaced or otherwise separated from each other such that lower plate receiving portions 864 are defined between adjacent fourth dividers 856. Therefore, when the first and second power contacts 634 and 636 are supported by the housing 614, the mating ends 660*a* of each power contact 634 and 636 at least partially extend into the second receptacle 840 such that mating ends 660*a* of the first power contacts 634 are separated from each other by the third dividers 852, and mating ends 660*a* of the second power contacts 636 are separated from each other by the fourth dividers 856.

The first, second, third and fourth dividers 822, 826, 852, and 856, respectively, each define a pair of side surfaces 870 that are joined by an inner surface 874. The inner surface 874 of each divider can have a longitudinal length that is greater than a transverse height of the side surfaces 870. The transverse height of the side surfaces 870 and the longitudinal length of the inner surface 874 for each divider 822, 826, 852, and 856 is such that a minimum creep distance between adjacent mating ends 660*a* of the first power contacts 634, and (also between adjacent mating ends 660*a* of the second power contacts 636) is between about 1.0 mm and about 5.0 mm. That is, the distance from adjacent mating ends 660*a* taken along the side surfaces 870 and inner surface 874 of the respective dividers is between about 1.0 mm and about 5.0 mm. In the illustrated embodiment, the minimum creep distance between adjacent mating ends 660*a* is about 2.19 mm. It should be understood, however, that the minimum creep distance between adjacent mating ends 660*a* may be any distance as desired. For example, the minimum creep distance can be between about 2.0 mm and about 4.0 mm. Moreover, the transverse height of the side surfaces 870 is such that the power connector 610 can be mated with a standard header connector without any modifications to the standard header connector. It should be understood, however, that the creep distance may be varied as desired. In other words, a distance H along the first direction is defined between the first dividers and the second dividers (and between the third dividers and the fourth dividers) that is no less than a maximum thickness of a contact bar of a standard header connector so as to not impede mating of the electrical connector 10 with a standard header connector.

The first, second, third, and fourth rows of power contacts 634 and 636 can be arranged such that a contact pitch CP measured along a second direction, such as the longitudinal direction L, between respective centers of adjacent mating ends of the same row is between about 11.0 mm and about 12.0 mm. In the illustrated embodiment, the power contacts 634 and 636 have a contact pitch CP of about 11.65 mm.

It has been found that a connector 610, as illustrated may have a maximum working voltage that is greater than 100 V, such as greater than 300 V. That is, the electrical connector 610 can have a voltage that is greater than 100 V, such as greater than 300 V that can be carried by each of the first and second successive contacts, without the voltage traveling from the first contact to the second contact across the region of lesser dielectric constant, such as air. For example, the electrical connector 610 may have a maximum working voltage of about 400V AC (566V DC) at a minimum creepage distance of about 2.19 mm, a pollution degree of two, and a material rated as Group One (CTI is greater than or equal to 600V). It has also been found that such a connector 610 may have a linear current density of about 262 A/inch, and a linear power density of at least 60 KW. In the illustrated embodiment, the electrical connector 10 has a linear power density of about 104.8 KW (or 148.3 KW for DC). It is noted that any interval integer or decimal voltage between or including 110 to 630V AC, 200 to 630V AC, 300 to 630V AC, or 400 to 630 V AC is contemplated by the present invention.

Figure 9:
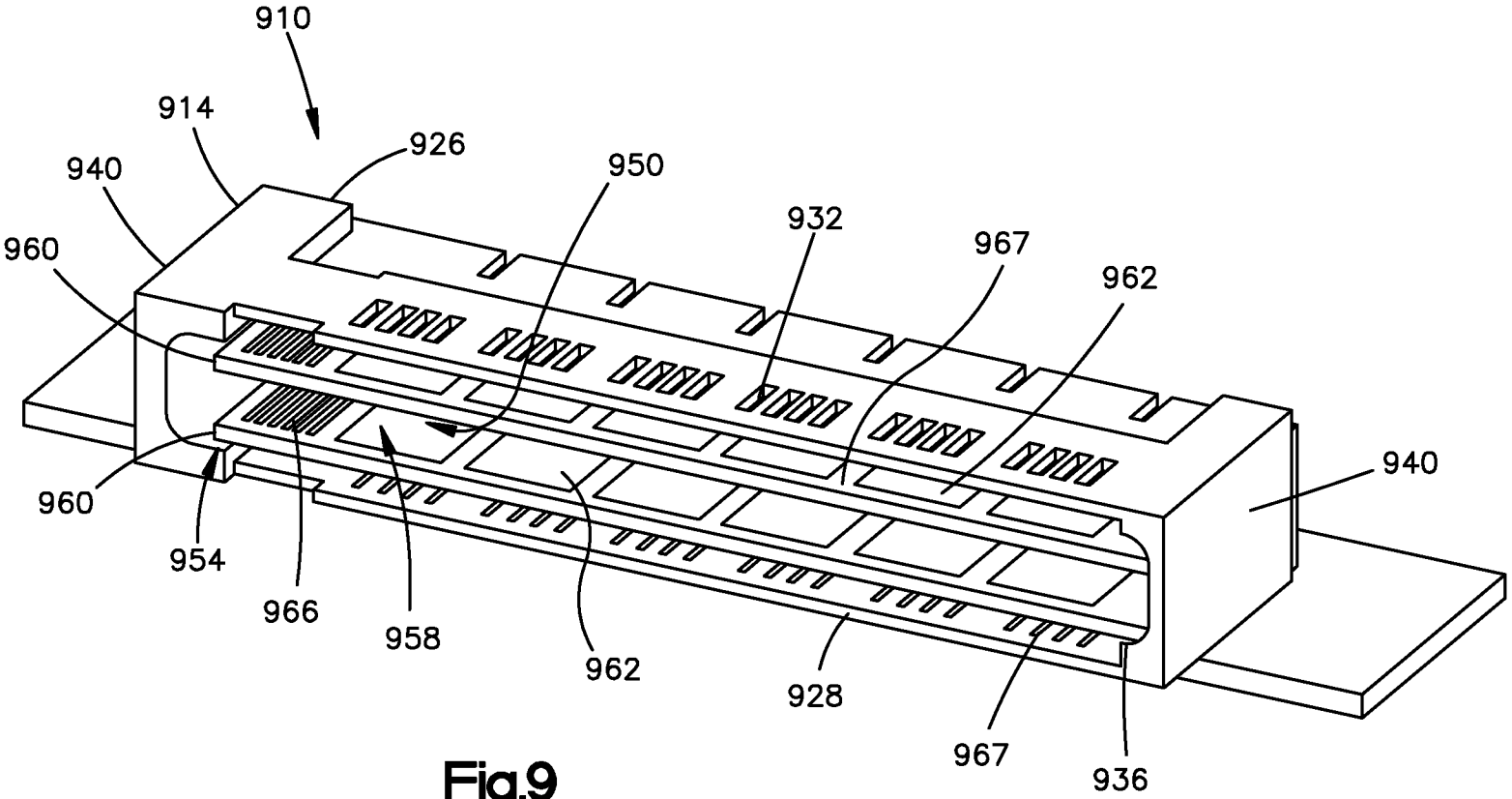
FIG. 9 is a perspective view of a right angle header connector configured to mate with the power connector shown in FIG. 7A.

The connector 610 may be mated with a header connector such as header connector 910 shown in FIG. 9. The header connector may be a standard connector. The header connector 910 is illustrated as a right angle header connector, though it should be understood that the header connector 910 may have other configurations. For example, the header connector 910 may be configured as a vertical header connector. The header connector 910 is constructed substantially identical with respect to the header connector 410 unless otherwise indicated. As shown, the header connector 910 includes a header connector housing 914 having a front end 926, a back end 928, an upper end 932, a lower end 936, and opposing side ends 940.

Like the power connector 610, the header connector 910 can be two tiered. As shown, the back end 928 provides a mating end 950 that defines a shroud 954 sized to receive the front end of the power connector 610. The shroud 954 defines an receptacle 958 that is configured to receive first and second (or upper and lower) rows 960 of plug contacts 962 and signal blade contacts 966. Each row 960 of plug contacts 962 and signal blade contacts 966 extends through a respective tier of the connector 910. Each row 960 of plug contacts 962 and signal blade contacts 966 may at least partially define a respective contact bar 967. Each contact bar 967 is configured to be received by the mating interfaces 758 and 762, respectively, of the electrical connector 10. The contact bars 467 have a transverse height "C". The transverse height C may the same as that found on a standard header connector.

The power connector 610 can be mated with the header connector 910 to form a power connector assembly. As shown, the upper row 960 of plug contacts 962 and signal blade contacts 966 are received by the power contacts 634 and 636 of the upper level 626 of power contacts 634 and 636 of the connector 610, and the lower row 960 of plug contacts 962 and signal blade contacts 966 are received by the power contacts 634 and 636 of the lower level 630 of power contacts 634 and 636 of the connector 610, when the connectors 610 and 910 are fully mated. The dividers 822, 826, 852, and 856 do not interfere with the plug contacts 962 and signal blade contacts 966 so as to prevent the connectors 610 and 910 from mating.

It should be appreciated that a method of operating an electrical power connector assembly, such as the assemblies disclosed, and in particular an electrical power receptacle connector of the assembly, can include the step of providing the power receptacle connector, attaching the mounting tails of the power contacts of the power receptacle connector to a substrate, such as a printed circuit board, receiving a plug contact of a header connector, or of a card edge, in the contact-receiving space defined by electrically isolated upper and lower power receptacle contacts, and driving electrical current through the power contacts of the receptacle connector at a current density greater than 150 Amps/linear inch.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. For example, while the embodiments disclosed are two tiered, it should be understood that the features may be incorporated into single tiered connectors. Furthermore, it should be appreciated that structures and features described above in connection with one or more embodiments can be included in all other embodiments, unless otherwise indicated. Those skilled in the relevant art, having the benefit of the teachings of this specification, may effect numerous modifications to the invention as described herein, and changes may be made without departing from the scope and spirit of the invention as defined by the appended claims.

What is claimed:

1. An electrical power connector comprising:

a connector housing including first and second walls that are spaced from each other so as to define a receptacle, the first wall including a plurality of first dividers that extend toward the second wall and the second wall including a plurality of second dividers that extend toward the first wall;

a first row of first power contacts supported by the housing, each first power contact defining a first mating end that extends at least partially into the receptacle; and a second row of second power contacts supported by the housing at a location spaced from the first row of first power contacts, each second power contact defining a second mating end that extends at least partially into the receptacle, wherein (i) the first mating ends are separated from each other by the first dividers such that a minimum creep distance between adjacent first mating ends measured along surfaces of a respective divider of the plurality of first dividers is between about 2 mm and about 4 mm, (ii) the second mating ends are separated from each other by the second dividers such that a minimum creep distance between adjacent second mating ends measured along surfaces of a respective second divider of the plurality of second dividers is between about 2 mm and about 4 mm, and (iii) the electrical power connector has a maximum working voltage that is greater than 100 V.

2. The electrical power connector of claim 1, wherein the first dividers are spaced from the second dividers along a first direction and a contact pitch measured between respective centers of adjacent first mating ends along a second direction that is perpendicular to the first direction is between about 11 mm and about 12 mm, and a contact pitch measured between respective centers of adjacent second mating ends along the second direction is between about 11 mm and about 12 mm.

3. The electrical power connector of claim 2, wherein the minimum creep distance between adjacent first power contacts and between adjacent second power contacts is about 2.19 mm.

4. The electrical power connector of claim 1, wherein the first dividers are spaced from the second dividers along a first direction and a contact pitch measured between respective centers of adjacent first mating ends along a second direction that is perpendicular to the first direction is between about 7 mm and about 8 mm, and a contact pitch measured between respective centers of adjacent second mating ends along the second direction is between about 7 mm and about 8 mm.

5. The electrical power connector of claim 1, wherein the first mating ends and the second mating ends each define four contact beams.

6. The electrical power connector of claim 1, wherein the connector housing further includes third and fourth surface that are spaced from each other so as to define a second receptacle, the third wall including a plurality of third dividers that extend toward the fourth wall and the fourth wall including a plurality of fourth dividers that extend toward the third wall.

7. The electrical power connector of claim 6, further comprising a third row of first power contacts and a fourth row of second power contacts each supported in the housing, wherein (i) each first power contact of the third row of first power contacts defines a first mating end that extends at least partially into the second receptacle, and (ii) each second power contact of the fourth row of second power contacts defines a second mating end that extends at least partially into the second receptacle.

8. The electrical power connector of claim 7, wherein the first mating ends of the third row of first power contacts are separated from each other by the third dividers, and the second mating ends of the fourth row of second power contacts are separated from each other by the fourth dividers such that a minimum creep distance between adjacent first mating ends and between adjacent second mating ends is between about 2.0 mm and about 4.0 mm.

9. The electrical power connector of claim 1, wherein the first dividers are spaced from the second dividers along a first direction, a distance measured along the first direction between the first dividers and the second dividers is no less than a minimum thickness of a contact bar of a standard header connector measured along the first direction.

10. The electrical power connector of claim 1, wherein each respective first divider and each respective second divider defines a pair of side surfaces that are joined by an inner surface, and the creep distance between adjacent mating ends is at least partially measured along at least a portion of each surface of the pair of side surfaces and along the inner surface.

11. An electrical power connector comprising:

a connector housing including first and second walls that are spaced from each other along a first direction so as to define a receptacle, the first wall including a plurality of dividers that extend toward the second wall, each of the dividers comprising a material that has a first dielectric constant, each of the dividers defining an outer surface; and a row of electrical power contacts supported by the housing, each power contact defining a mating end that is at least partially disposed in the receptacle such that a contact pitch measured along a second direction that is perpendicular to the first direction between respective centers of adjacent mating ends is between about 7 mm and about 12 mm, wherein a select one of the dividers is disposed between first and second successive ones of the power contacts of the row, the connector housing defining a region having a second dielectric constant less than the first dielectric constant, the region disposed between the first and second successive ones of the power contacts;

wherein (i) the connector defines a shortest distance between the first and second successive ones of the power contacts, the shortest distance measured 1) at least partially along the outer surface of the select one of the dividers and 2) only in the region, such that no other distance measured between the first and second successive ones of the power contacts at least partially along the outer surface of the select one of the dividers and only in the region is shorter than the shortest distance, (ii) the shortest distance is between about 2 mm and about 4 mm, and (iii) the electrical power connector has a maximum working voltage that is greater than 400 V.

12. The electrical power connector of claim 11, wherein the shortest distance is a minimum creep distance, and the second wall includes a plurality of second dividers that extend toward the first wall, the electrical power connector further comprising a second row of electrical contacts supported by the housing, each power contact defining a mating end that is at least partially disposed in the receptacle, wherein a select one of the second dividers is disposed between first and second successive ones of the power contacts of the second row, such that the minimum creep distance between the first and second successive ones of the power contacts of the second row is between about 2 mm and about 4 mm.

13. The electrical power connector of claim 12, wherein the receptacle is a first receptacle, and wherein the connector housing further includes third and fourth walls that are spaced from each other so as to define a second receptacle, the third wall including a plurality of third dividers that extend toward the fourth wall and the fourth wall including a plurality of fourth dividers that extend toward the third wall.

14. The electrical power connector of claim 13, further comprising a third row of electrical power contacts and a fourth row of electrical power contacts each supported in the housing, each electrical power contact of the third and fourth rows defining a mating end that is at least partially disposed in the second receptacle, wherein a select one of the third dividers is disposed between first and second successive ones of the power contacts of the third row, such that the minimum creep distance between the first and second successive ones of the power contacts of the third row is between about 2 mm and about 4 mm, and a select one of the fourth dividers is disposed between first and second successive ones of the power contacts of the fourth row, such that the minimum creep distance between the first and second successive ones of the power contacts of the fourth row is between about 2 mm and about 4 mm.

15. The electrical power connector of claim 12, wherein each power contact defines a pair of contact beams.

16. The electrical power connector of claim 12, wherein the first dividers are spaced from the second dividers along a first direction, a distance measured along the first direction between the first dividers and the second dividers is no less than a minimum thickness of a contact bar of a standard header connector measured along the first direction.

17. The electrical power connector of claim 11, wherein the contact pitch measured between respective centers of adjacent mating ends is between about 7 mm and about 8 mm.

18. The electrical power connector of claim 11, wherein the contact pitch measured between respective centers of adjacent mating ends is between about 11 mm and about 12 mm.

19. The electrical power connector of claim 11, wherein the shortest distance is about 3.2 mm.

20. An electrical power connector comprising:

a connector housing having a front end that defines a first mating interface that includes first and second walls spaced from each other so as to define a first receptacle and a second mating interface spaced from the first mating interface along a first direction, the second mating interface includes third and fourth walls spaced from each other so as to define a second receptacle, the first wall having a plurality of first dividers that extend toward the second wall, the second wall having a plurality of second dividers that extend toward the first wall, the third wall having a plurality of third dividers that extend toward the fourth wall, and the fourth wall having a plurality of fourth dividers that extend toward the third wall;

a first row of contact beams supported by the housing, each contact beam extending at least partially into the first receptacle;

a second row of contact beams supported by the housing, each contact beam of the second row extending at least partially into the first receptacle;

a third row of contact beams supported by the housing, each contact beam of the third row extending at least partially into the second receptacle; and a fourth row of contact beams supported by the housing, each contact beam of the fourth row extending at least partially into the second receptacle;

wherein (i) groups of at least two contact beams of the first row of contact beams are separated from each other by the first dividers, groups of at least two contact beams of the second row of contact beams are separated from each other by the second dividers, groups of at least two contact beams of the third row of contact beams are separated from each other by the third dividers, and groups of at least two contact beams of the fourth row of contact beams are separated from each other by the fourth dividers such that a minimum creep distance between adjacent groups of contact beams of the first row, between adjacent groups of contact beams of the second row, between adjacent groups of contact beams of the third row, and between adjacent groups of contact beams of the fourth row is between about 1.0 mm and about 5.0 mm, and (ii) the electrical power connector has a maximum working voltage that is greater than 300 V.

* * * * *